United States Patent [19]

White

[11] 3,942,300

[45] Mar. 9, 1976

[54] APPARATUS FOR LAPPING A CONTINUOUS LENGTH OF HONEYCOMB MATERIAL

[75] Inventor: Desmond Deverell White, Dyserth, England

[73] Assignee: Dufaylite Developments Limited, Great Britain

[22] Filed: Apr. 8, 1974

[21] Appl. No.: 458,957

[52] U.S. Cl. ..... 53/59 R; 53/116; 270/30

[51] Int. Cl.[2] ..... B65B 57/14; B65B 63/04

[58] Field of Search ..... 53/116, 117, 59 R; 270/30

[56] References Cited

UNITED STATES PATENTS

| | | | |
|---|---|---|---|
| 2,301,006 | 11/1942 | Baker et al. | 53/116 X |
| 3,059,308 | 10/1962 | Friedel | 53/116 X |
| 3,557,524 | 1/1971 | Zimmerman | 53/116 |

*Primary Examiner*—Travis S. McGehee
*Attorney, Agent, or Firm*—William A. Drucker

[57] ABSTRACT

The invention provides for lapping a continuous length of unexpanded structural honeycomb material, a guideway for guiding the material downwardly to an outlet whilst restraining it from shearing movement, a reciprocable support for receiving the material from the outlet, and compensating means for permitting movement of the outlet relative to the support to compensate for the accumulation of material lapped by reciprocation of the support. Conveniently, the outlet has a pair of gates, one on either side, operable to prevent feeding of the material in the wrong direction. By making the feeding of the material through the outlet and the reciprocation responsive to the existence of a minimum head of material, the apparatus is rendered self-adjusting to the rate of supply of honeycomb material.

14 Claims, 3 Drawing Figures

APPARATUS FOR LAPPING A CONTINUOUS LENGTH OF HONEYCOMB MATERIAL

Figure 1:
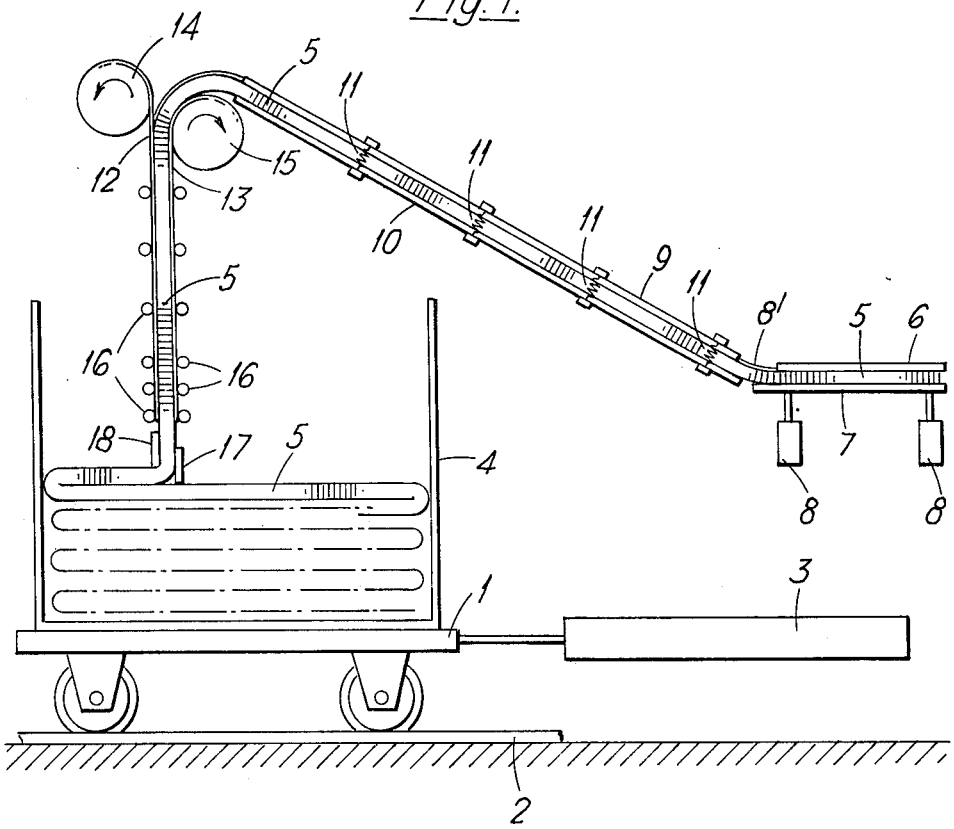

The present invention relates to structural honeycomb materials and especially to apparatus for providing said materials in a readily usable form.

In Specification No. 591,772 and other specifications we have described the production of structural honeycomb material by slicing blocks formed of layers of sheet material, usually paper or thin cardboard, adhesively secured together by bands of adhesive. The slices thus obtained, are expandable to the open cellular, normally generally hexagonal state by pulling them open in a direction corresponding with the thickness direction of the blocks. Forming slices in this way gives great versatility in production as it is a simple matter to vary the thickness of the slices cut from the blocks. It is also simple to change the width of sheet material used in forming the blocks, and/or the spacing between the bands of adhesive. The versatility is obtained together with a commercially satisfactory rate of production but the provision of the material in the form of slices is inconvenient for some purposes. Problems arise in handling them automatically, and there can be cutting losses when the size of expanded material required is not an integral multiple of that obtained from a single slice.

The manufacture of the material in a continuous form is a known alternative to manufacture in slices, but tends to be more expensive, to be less versatile and to introduce handling problems.

In accordance with the present invention, there is provided apparatus for lapping a continuous length of unexpanded structural honeycomb material to provide a supply of the material in the form of a pile of superposed unexpanded layers, in which pile each intermediate layer is connected at one end (taken in the direction of expansion of the material), via a bend in the material, with the adjacent layer on one side thereof and at the opposite end, via another bend in the material, with the adjacent layer on the opposite side thereof, said apparatus comprising a guideway formed and arranged to guide the material downwardly to an outlet from the guideway whilst restraining it from shearing movement and deliver it through the outlet in a compressed state, a support for reception of the pile or a container therefor, means for producing a reciprocal lapping motion of the support relative to the outlet from the guideway, and compensating means permitting movement of the outlet relative to the support to compensate for the accumulation of material lapped by the lapping motion.

With the apparatus, a pile of lapped, unexpanded material is obtainable in a reliable manner. The continuous length of material may be manufactured directly as such or may be produced by glueing slices together. In the latter case, the compressed state referred to is conducive to good adhesion. We have previously described the provision of unexpanded honeycomb material in lapped form as feedstock for a continuous lamination process. Successful results were obtained, and feedstock of this kind was found to be attractive but difficult to produce except by careful manual effort. The correction of inevitable errors was a very laborious operation. Desired results are achieved in accordance with the present invention, in spite of the mechanical properties of the material without inordinate capital cost.

Advantageously, the apparatus has a transducer operable to permit the lapping motion and passage of material through the outlet only when the guideway contains an amount of oncoming material sufficient to maintain the material at the outlet under adequate compression. Adequate compression ensures that the layers are formed ragularly with the honeycomb in an unexpanded state and is accordingly readily recognisable when obtained, perhaps after simple experiment.

For best results the outlet from the guideway may be provided with a pair of closure devices, one on each side thereof, said closure devices being operable to prevent feeding of the material in the non-required direction during lapping. Any feeding of the material in the non-required direction, even for a brief period, can be very difficult to correct. Suitably, the closure devices are shutters provided with fluid operable, preferably pneumatic actuators.

The guideway is preferably provided in the form of a pair of contractable guide members arranged to define a passageway for the downward feeding of the material therebetween, and the compensating means is operable to contract said guide members as the lapped material accumulates. This arrangement is convenient in practice as it allows the support to be reciprocated at a constant level, thus avoiding lowering and lifting problems. For a large and heavy pile, such problems are significant. conveniently the support is a carriage, e.g. a wheeled carriage mounted on rails, reciprocable by a fluid operated, preferably hydraulic, ram, to produce the lapping motion.

The guide members are advantageously contractable by flexible tension members, such as wires, metal tapes, or chains. Tension members of this kind are readily operated. They may be pulled to contract the guide members by winding them on a drum or drums, or they may be pulled linearly (not necessarily in the direction of contraction) by, for example, fluid operated devices or lead-screw operated devices.

For feeding the material to the guideway, the apparatus is preferably provided with a feedway constituted to exert pressure upon the material so that the material is compressed in its direction of travel and restrained from shearing movement on being pushed through the feedway to the guideway. A suitable form of feedway is two sets of bars extending in the direction of travel of the material, said sets of bars being biased together to exert pressure upon the material as it is pushed therebetween towards the guideway.

Figure 2:
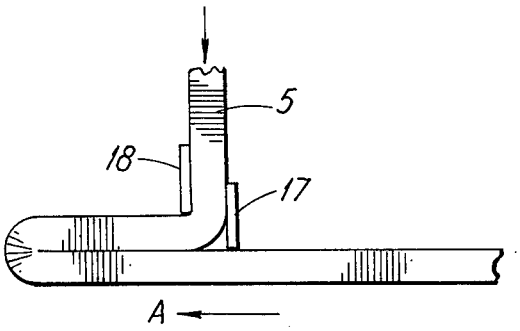
Figure 3:
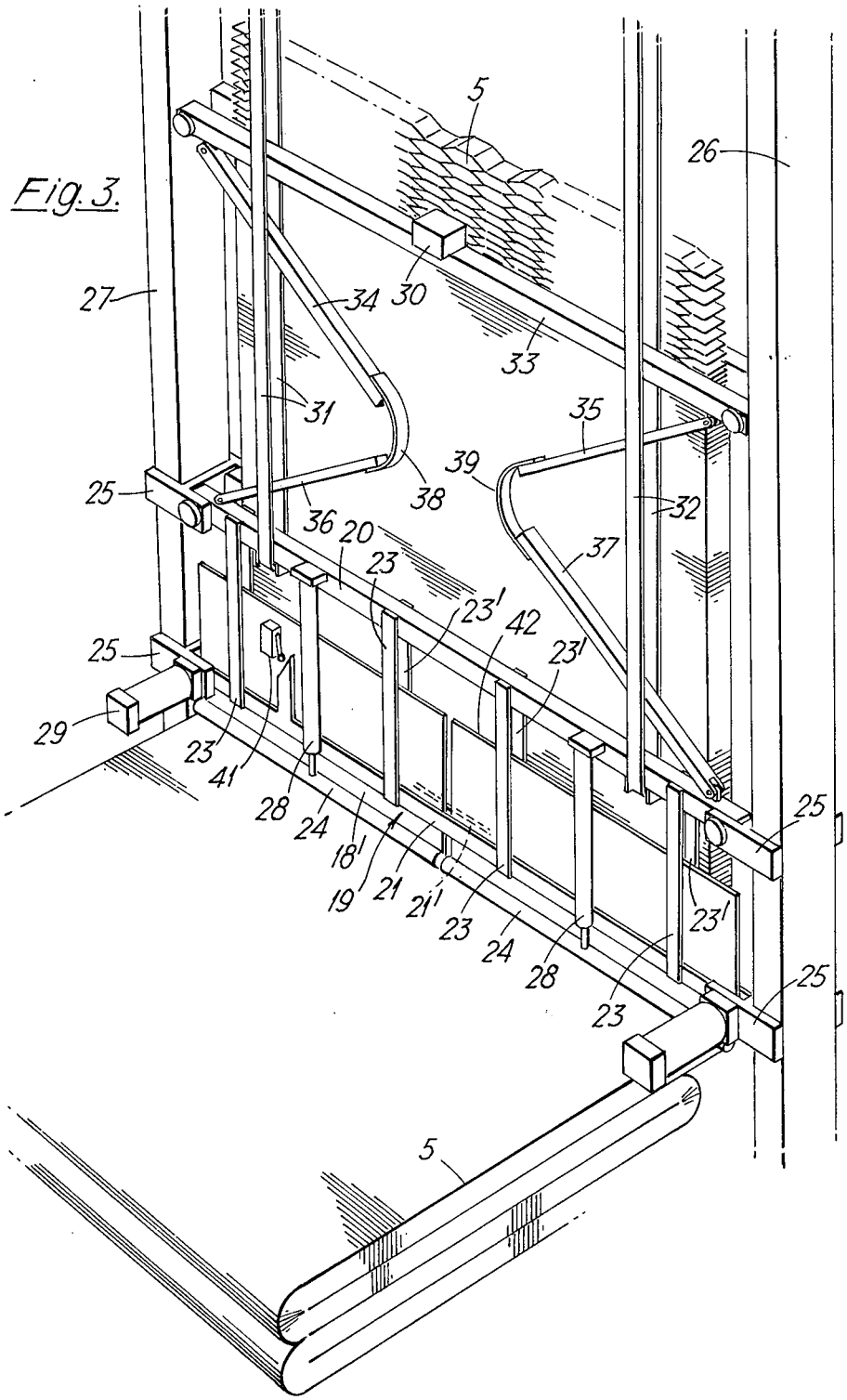

The following description in which reference is made to the accompanying drawings is given in order to illustrate the invention. In the drawings:

FIG. 1 is a diagrammatic general view of an apparatus in accordance with the invention, FIG. 2 shows, on a larger scale than FIG. 1, the manner in which the honeycomb material is lapped, and FIG. 3 shows in perspective a modified form of guideway which may be provided on an apparatus according to FIG. 1.

The apparatus of FIG. 1 has a wheeled trolley 1, reciprocable along floor-mounted rail track 2 by a hydraulic ram 3, serving as a support for a stillage 4 of wood or other convenient material. Continuous unexpanded honeycomb material 5 is push-fed into the apparatus between a set of parallel bars 6 which extend in the direction of travel and a platen 7 carried by pneumatic rams 8. These rams enable the platen to be lowered when setting-up the machine and raised to give the material 5 a close sliding fit below the bars 6.

Connected with the bars 6 by lengths of spring steel 8', are upwardly sloping parallel bars 9 arranged above a lower set of parallel bars 10. These two sets of bars are spring biased together (as diagrammatically indicated at 11) to provide a feedway through which the material is pushed upwardly under confining pressure.

As it emerges from the end of the feedway, the material is curved downwardly by curved strips of spring steel attached to the ends of the bars 9 to enter the top of a vertical guideway. This guideway is formed of vertical wires 12 and 13, carried by winding drums 14 and 15, and interconnected by horizontal bars 16 to form a suspended structure of variable length. At its lower end the guideway has an outlet provided with a pair of shutters 17 and 18, one on either side, mounted to be opened one at a time by raising them by pneumatic actuators (not shown).

During its descent through the guideway, the material is confined by the wires and bars so that it is restrained against shearing motions and is maintained in a compressed state. Especially, at the outlet, the compression is promoted by the weight of the descending material. As the material is fed downwardly, the trolley and stillage are reciprocated by the ram 3 so that the material is laid with the stillage in layers. When the motion is reversed, the on-coming material is folded back through 180° to be laid upon the last-formed layer.

Referring to FIG. 2, it will be seen that as the stillage and trolley move in the direction A, the shutter 18 is open to feed the emergent material to the required side of the outlet. Shutter 17 is closed to prevent emergent material spilling out in the non-required direction. At the end of each stroke, the shutters are reversed and the outlet is raised through a distance equal to the thickness of the material by rotation of the drums 14 and 15.

The guideway shown in FIG. 3 avoids the provision of the horizontal bars 16. It is formed of two similar assemblies, one for each face of the descending material, of which only one assembly appears in FIG. 3.

Each assembly has an outlet section generally indicated at 19, in which a framework consisting of an upper transverse member 20 and a pair of lower transverse members 21, 21' joined by pairs of struts 23, 23' connected with their outer faces, houses a shutter 18' provided in the form of two aluminium panels arranged end to end, is slidable vertically between the lower members 21, 21' and has two rollers 24, one at the bottom edge of each panel for engagement with the honeycomb material 5. The upper edges of the shutter 18' is shown at 42.

The upper and lower transverse members of each assembly connect with fork members 25 which slidably engage vertical guide columns 26 and 27 mounted one on either side of the rail track 2, so that the stillage 4 and trolley 1 are reciprocable between them. The assemblies are thus constrained to move only in the direction of delivery of the material 5.

A pair of pneumatic rams 28 carried by the upper transverse member 20 is arranged to raise and lower the panels of the shutter 18' as required.

A pair of pneumatic or hydraulic rams 29, one for each aluminium panel is arranged to press its panel against the descending material 5. Rams 29 and 3 are controlled by a circuit responsive to a photo responsive device 30. When light is received by device 30 through the descending material 5, the (four) panels are clamped against the material to prevent its descent, and movement of the stillage 4 by the ram 3 is stopped. The accumulation of descending material eventually cuts off light from device 30 to unclamp the gates and actuate the ram 3. Device 30 is arranged at a level such as to provide an adequate head of compression of the material for satisfactory lapping in the stillage. Thus, the lapping operation is performed intermittently in such a manner as to adjust itself to the rate of supply of the material. The absence of any requirement that the rate of supply should be uniform, or at any particular average rate, makes the apparatus very versatile.

In FIG. 3, the material 5 is shown as it appears when illumination of device 30 is about to cease or about to begin. Above the level of device 30, the material is in a partially expanded state.

The upper transverse member 20 is suspended between two pairs of steel tapes 31 and 32, carried by a winding shaft (not shown: cf. 14 and 15), for raising and lowering them as required.

Above the member 20, is a horizontal cross bar 33 extending between the two pairs of tapes and linked with member 20 by four arms 34, 35, 36 and 37, of such thickness as to have a close sliding fit between the tapes. The upper ends of arms 34 and 35, and the lower ends of arms 36 and 37, are pivotably attached to the bar 33 and the member 20 respectively, and the other ends are joined as shown by strips 38 and 39 of spring steel. The arms 34 to 37 and the pairs of tapes 31, 32 co-operate to form a fence of variable height for confining the descending material. A similar fence arrangement (not shown) is provided above the bar 33.

The assembly just described with reference numerals 19 to 24 and 28 to 39 is duplicated (apart from the rams 29) to confine the descending material on both sides. The fork members 25 are common to the two assemblies and thus link them together.

During lapping, the gate which is down rests upon the laid material by its weight only and does not disturb this material. The gate which is up, is held by pneumatic pressure in its operating rams. Limit switches such as the switch 41 provide a holding function.

I claim:

1. A system of apparatus for lapping a continuous length of unexpanded structural honeycomb material to form an accumulation of superposed unexpanded continuously connected layers comprising the combination of:

A. a guideway to confine and guide the material downwardly and allow the material to compress under its own weight and to deliver it in a compressed state confined and restrained from buckling to;

B. an outlet from said guidway;

C. support means for reception of the confined and compressed material from said outlet;

D. means for reciprocal lapping motion of said support relative to said outlet;

E. compensating means permitting movement of said outlet relative to said support to compensate for accumulation of compressed material lapped; and F. means responsive to the amount of material in the guideway which means controls feed of the material into the guideway.

2. Apparatus according to claim 1, in which the outlet from the guideway is provided with a pair of closure devices, one on each side thereof, said closure devices being operable to prevent feeding of the material in the non-required direction during lapping.

3. Apparatus according to claim 2 in which the closure devices are shutters provided with fluid-operable actuators.

4. Apparatus according to claim 1 in which the guideway is provided in the form of a pair of contractable guide members arranged to define a passageway for the downward feeding of the material therebetween, and the compensating means is operable to contract said guide members as the lapped material accumulates.

5. Apparatus according to claim 4 in which the guide members are contractable by flexible tension members.

6. Apparatus according to claim 4, in which the contractable guide members are constrained to move only in the direction of delivery of the material by engagement with guide columns.

7. Apparatus according to claim 1, having a transducer operable to permit the lapping motion and passage of material through the outlet only when the guideway contains an amount of oncoming material sufficient to maintain the material at the outlet under adequate compression.

8. Apparatus according to claim 1 having a feedway for delivering the material to the guideway, said feedway being constituted to exert pressure upon the material so that the material is compressed in its direction of travel and restrained from shearing movement on being pushed through the feedway to the guideway.

9. Apparatus according to calim 8 in which the feedway is provided in the form of two sets of bars extending in the direction of travel of the material, said sets of bars being biased together to exert pressure upon the material as it is pushed therebetween towards the guideway.

10. Apparatus according to claim 1 in which the said support is a carriage reciprocable by a fluid operated ram to produce the lapping motion.

11. In a system of apparatus for lapping a continuous length of unexpanded structural honeycomb material to form an accumulation of superposed unexpanded continuously connected layers comprising the combination of:

A. a guideway to confine and guide the material downwardly and allow the material to compress under its own weight and to deliver it in a compressed state confined and restrained from buckling to;

B. an outlet from said guideway;

C. support means for reception of the confined and compressed material from said outlet;

D. means for reciprocal lapping motion of said support relative to said outlet;

E. compensating means permitting movement of said outlet relative to said support to compensate for accumulation of compressed material lapped; and the improvement in which the outlet from the guideway is provided with a pair of closure devices, one on each side thereof, said closure devices being operable to prevent feeding of the material in the non-required direction during lapping.

12. In a system of apparatus for lapping a continuous length of unexpanded structural honeycomb material to form an accumulation of superposed unexpanded continuously connected layers comprising the combination of:

A. a guideway to confine and guide the material downwardly and allow the material to compress under its own weight and to deliver it in a compressed state confined and restrained from buckling to;

B. an outlet from said guideway;

C. support means for reception of the confined and compressed material from said outlet;

D. means for reciprocal lapping motion of said support relative to said outlet;

E. compensating means permitting movement of said outlet relative to said support to compensate for accumulation of compressed material lapped; and the improvement in which the guideway is provided in the form of a pair of guide members, contractable by flexible tension members and arranged to define a passageway for the downward feeding of the material therebetween, and the compensating means is operable to contract said guide members as the lapped material accumulates.

13. In a system of apparatus for lapping a continuous length of unexpanded structural honeycomb material to form an accumulation of superposed unexpanded continuously connected layers comprising the combination of:

A. a guideway to confine and guide the material downwardly and allow the material to compress under its own weight and to deliver it in a compressed state confined and restrained from buckling to;

B. an outlet from said guideway;

C. support means for reception of the confined and compressed material from said outlet;

D. means for reciprocal lapping motion of said support relative to said outlet;

E. compensating means permitting movement of said outlet relative to said support to compensate for accumulation of compressed material lapped; and the improvement in which there is provided a transducer operable to permit the lapping motion and passage of material through the outlet only when the guideway contains an amount of oncoming material sufficient to maintain the material at the outlet under adequate compression.

14. In a system of apparatus for lapping a continuous length of unexpanded structural honeycomb material to form an accumulation of superposed unexpanded continuously connected layers comprising the combination of:

A. a guideway to confine and guide the material downwardly and allow the material to compress under its own weight and to deliver it in a compressed state confined and restrained from buckling to;

B. an outlet from said guideway;

C. support means for reception of the confined and compressed material from said outlet;

D. means for reciprocal lapping motion of said support relative to said outlet;

E. compensating means permitting movement of said outlet relative to said support to compensate for accumulation of compressed material lapped; and the improvement in which there is provided a feedway for delivering the material to the guideway, said feedway being constituted to exert pressure upon the material so that the material is compressed in its direction of travel and restrained from shearing movement on being pushed through the feedway to the guideway.

* * * * *